US007367835B2

(12) United States Patent
Takahashi

(10) Patent No.: US 7,367,835 B2
(45) Date of Patent: May 6, 2008

(54) LOCK MECHANISM OF CONNECTOR AND CONNECTOR

(75) Inventor: Takakazu Takahashi, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/606,056

(22) Filed: Nov. 30, 2006

(65) Prior Publication Data

US 2007/0155209 A1 Jul. 5, 2007

(30) Foreign Application Priority Data

Nov. 30, 2005 (JP) ..... P2005-346664

(51) Int. Cl.
*H01R 13/627* (2006.01)

(52) U.S. Cl. ..... 439/354

(58) Field of Classification Search ..... 439/350–358
See application file for complete search history.

(56) References Cited

U.S. PATENT DOCUMENTS

2003/0045153 A1* 3/2003 Yamawaki ..... 439/352

FOREIGN PATENT DOCUMENTS

JP 2003-045566 A 2/2003

* cited by examiner

*Primary Examiner*—Javaid H. Nasri
(74) *Attorney, Agent, or Firm*—Sughrue Mion, PLLC

(57) ABSTRACT

A lock mechanism of a connector includes a connector body portion, a hood portion and a lock arm. The connecting portion of the lock arm is integrally connected to the hood portion at the first side, the extending portion extends from the connecting portion to the depressing portion in a first direction of fitting the mating connector into the connector body portion, and the depressing portion is arranged at a second side which is away from the mating connector than the first side in the first direction. A first slit is formed in the end wall of the hood portion, and has a width larger than a width of an interconnecting portion which connect the connecting portion of the lock arm to the hood portion, so that the first slit applies elastic deformability, corresponding to the width of the first slit, to a part of the hood portion including the interconnecting portion. A pair of protection side walls are provided respectively at both sides of the lock arm to protect the lock arm, and are separated from the lock arm, and have a height generally equal to a height of the lock arm.

4 Claims, 3 Drawing Sheets

LOCK MECHANISM OF CONNECTOR AND CONNECTOR

The present application is based on Japan Patent Application No. 2005-346664 filed on Nov. 30, 2005, the contents of which are incorporated herein for reference.

BACKGROUND OF THE INVENTION

This invention relates to a connector used for connecting an automotive wire harness or the like, and more particularly to a lock mechanism of a connector which has a lock arm for engagement with a retaining portion of a mating connector.

In a related connector, a lock arm of the type described has been provided on an outer surface of a hood portion for fitting on a mating connector. In this case, the height of the connector is increased by an amount corresponding to the height of the lock arm projecting outwardly from the hood portion, and this has been a barrier to the achievement of a low-height design of the connector.

On the other hand, there is known a related connector in which a lock arm is formed integrally on a hood portion, and the upper side of the lock arm is covered by a bulging wall for protecting purposes (see, for example, JP-A-2003-45566). FIG. 5 is a cross-sectional view showing the related connector disclosed in JP-A-2003-45566.

In FIG. 5, reference numeral 110 denotes a male connector, and reference numeral 120 denotes a female connector. The male and female connectors 110 and 120 are connected together, and the male connector 110 includes a connector body portion 111 for receiving terminals (not shown), the hood portion 114 which is provided around the outer periphery of the connector body portion 111, and is integrally connected by its rear end wall 112 to the connector body portion 111 such that a blind-type annular space 113 (into which the female connector 120 is fitted from the front side) is formed between the outer periphery of the connector body portion 111 and the hood portion 114, the elastic lock arm 116 which is integrally connected at its front end portion to the hood portion 114, and extends rearwardly from its front end portion in a direction parallel to a connector fitting direction, and has a depressing portion 115 for lock cancellation purposes formed at its a rear end, a lock projection 117 which is formed on a lower surface of the lock arm 116 at an intermediate portion thereof in the forward-rearward direction of the lock arm 116, and is exposed to the annular space 113, and can be engaged with a retaining portion 121 (formed by front and rear convex portions 121*a* and 121*b*) formed on the outer periphery of the female connector 120, and the bulging wall 118 which is formed outwardly of the hood portion 114 to cover a generally front half portion of the lock arm 116 to protect this lock arm 116. The retaining portion 121 of the female connector 120 is formed by the front and rear convex portions 121*a* and 121*b* spaced from each other in the forward-rearward direction.

Even in the case where the hood portion 114 and the lock arm 116 are formed integrally with each other as shown in FIG. 5, it has been difficult to achieve a low-height design of the connector (that is, to reduce the height H of the connector) since the related lock mechanism has the bulging wall 118 provided to cover the upper side of the lock arm 116 for the purpose of protecting this lock arm 116.

SUMMARY OF THE INVENTION

This invention has been made in view of the above circumstances, and an object of the invention is to provide a lock mechanism of a connector and a connector with this lock mechanism, in which a low-height design of the connector can be achieved while protecting a lock arm.

The above object has been achieved by a lock mechanism of a connector having features recited in the following Paragraphs (1) to (5).

(1) A lock mechanism of a connector comprising a hood portion provided around an outer periphery of a connector body portion receiving terminals therein, wherein the hood portion is integrally connected at its rear end wall to the connector body portion such that a blind-type annular space into which a mating connector can be fitted from a front side is formed between the hood portion and the outer periphery of the connector body portion; and the lock mechanism includes:

a lock arm which has a front end portion integrally connected to the hood portion, and a rear end portion having a depressing portion for lock cancellation purposes, and extends rearwardly from the front end portion in a direction parallel to a connector fitting direction;

a lock projection which is formed on an inner surface of that portion of the hood portion to which the front end portion of the lock arm is integrally connected, and can be engaged with a retaining portion formed on an outer periphery of the mating connector;

a first slit which is formed in the rear end wall of the hood portion, and has a width larger than a width of an interconnecting portion of the front end portion of the lock arm integrally connected to the hood portion, so that the slit can impart elastic deformability, corresponding to its width, to part of the hood portion including the portion thereof integrally connected to the front end portion of the lock arm; and a pair of right and left protection side walls which are provided respectively at right and left sides of the lock arm to protect the lock arm, and are separate from the lock arm, and extend upwardly from the connector body portion to a height generally equal to a height of the lock arm.

(2) The lock mechanism of the connector of the above Paragraph (1) is further characterized in that the lock arm is provided as an uppermost element in the direction of the height of the connector in such a manner that the whole of an upper surface of the lock arm is exposed.

(3) The lock mechanism of the connector of the above Paragraph (1) or Paragraph (2) is further characterized in that a rib is formed on an outer periphery of a front end portion of the hood portion (to which the front end portion of the lock arm is integrally connected) by thickening a localized portion of the hood portion, and extends over a range corresponding to the width of the first slit.

(4) The lock mechanism of the connector of the above Paragraph (3) is further characterized in that front end portions of the protection side walls extend to the rib formed on the outer periphery of the front end portion of the hood portion, and are integrally connected to the rib such that the front end portions of the protection side walls have a height generally equal to the height of the rib, and each of the protection side walls has a second slit extending from the rear end portion of the hood portion to a portion of the protection side wall disposed forwardly adjacent to a rear end of the protection side wall, such that the protection side wall has an interconnecting leg portion formed at the rear side of the second slit and integrally connected to the connector body portion, and the second slit is continuous with the first slit formed in the rear end wall of the hood portion.

(5) The lock mechanism of the connector of any one of the above Paragraphs (1) to (5) is further characterized in that the lock arm has a fulcrum projection provided between the front end portion thereof, integrally connected to the hood portion, and the depressing portion formed at the rear end portion thereof, and when the depressing portion is depressed toward the connector body portion, the fulcrum projection is stopped by the connector body portion, and serves as a fulcrum for leverage so as to cause the front end portion of the lock arm to be displaced upward.

In the lock mechanism of the construction of the above Paragraph (1), although there is not provided any bulging wall, the lock arm is protected by the protection side walls extending upwardly from the connector body portion, and therefore it is not feared that the lock arm is immoderately moved by an external force. And besides, the protection side walls are separate from the lock arm, and therefore will not adversely affect the elastic deformability of the lock arm. Furthermore, in the lock mechanism of the construction of the above Paragraph (1), for fitting the two connectors together or for disengaging the connectors from each other, the lock projection on the inner surface of the hood portion can be brought into and out of locking engagement with the retaining portion of the mating connector while elastically deforming part of the hood portion thanks to the provision of the slit in the rear end wall of the hood portion. In this case, the elastic deformability (that is, the degree of elastic deformation) of the hood portion can be determined by the width of the slit, and therefore an inserting force required for the connectors and a canceling force required for the lock arm can be easily suitably adjusted at the stage of the design.

In the lock mechanism of the construction of the above Paragraph (2), the lock arm, integrally connected at its front end portion to the hood portion, is provided as the uppermost element in the direction of the height of the connector in such a manner that the whole of the upper surface of this lock arm is exposed, and therefore there is not provided any element (such as the bulging wall) which would prevent the achievement of the low-height design, and the height of the connector can be reduced to a low level generally equal to the height of the hood portion.

In the lock mechanism of the construction of the above Paragraph (3), the rib is formed on the outer periphery of the front end portion of the hood portion (to which the front end portion of the lock arm is integrally connected) by thickening the localized portion of the hood portion, and extends over the range corresponding to the width of the slit, and therefore the hood portion can be reinforced without adversely affecting the elastic deformability of part of the hood portion. Particularly, in the lock mechanism of the construction of the above Paragraph (3), the portion of the hood portion to which the front end portion of the lock arm is integrally connected and on which stresses are liable to concentrate can be reinforced. And besides, in the lock mechanism of the construction of the above Paragraph (3), the effect of dispersing the stresses over the range or region where the rib is provided can be achieved, and therefore the hood portion can be elastically deformed over a wide range, so that a high degree of elastic deformation can be imparted to the hood portion.

In the lock mechanism of the construction of the above Paragraph (4), the front end portions of the protection side walls extend to the rib, and are integrally connected to this rib, and therefore a front half portion of the lock arm can also be protected from an inadvertent external force. And besides, the slit, which extends from the rear end of the hood portion to the portion of the protection side wall disposed forwardly adjacent to the rear end of the protection side wall, and is continuous with the slit in the rear end wall of the hood portion, is formed in each of the thus extended protection side walls, and therefore it is not feared that the elastic deformability of the hood portion is adversely affected by the protection side walls.

In the lock mechanism of the construction of the above Paragraph (5), the lock arm has the fulcrum projection (serving as the fulcrum for leverage) formed between the front end portion thereof (integrally connected to the hood portion) and the depressing portion formed at the rear end portion thereof, and therefore when the depressing portion at the rear end portion of the lock arm is depressed, the front end portion of the lock arm (integrally connected to the hood portion) can be easily lifted with the fulcrum projection functioning as a support point. Therefore, the locking engagement of the lock projection with the retaining portion of the mating connector can be easily canceled.

The above object has also been achieved by the connector provided with the lock mechanism as recited in any one of the above Paragraphs (1) to (5).

The present invention can achieve an excellent advantage that the low-height design of the connector can be achieved while protecting the lock arm.

According to the present invention, there is also provided a lock mechanism of a connector, comprising:

a connector body portion that receives terminals therein;

a hood portion that is provided around an outer periphery of the connector body portion so that an annular space into which a mating connector can be fitted from a first side is formed between the hood portion and the outer periphery of the connector body portion; and a lock arm that includes a connecting portion, an extending portion and a depressing portion for lock cancellation, wherein the connecting portion of the lock arm is integrally connected to the hood portion at the first side, the extending portion extends from the connecting portion to the depressing portion in a first direction of fitting the mating connector into the connector body portion, and the depressing portion is arranged at a second side which is away from the mating connector than the first side in the first direction;

wherein an end wall of the hood portion is integrally connected at the second side to the connector body portion;

wherein a first slit is formed in the end wall of the hood portion, and has a width larger than a width of an interconnecting portion which connect the connecting portion of the lock arm to the hood portion, so that the first slit applies elastic deformability, corresponding to the width of the first slit, to a part of the hood portion including the interconnecting portion; and wherein a pair of protection side walls are provided respectively at both sides of the lock arm to protect the lock arm, and are separated from the lock arm, and have a height generally equal to a height of the lock arm.

Preferably, the lock arm is provided as an uppermost element in a direction of the height of the connector such that a whole of an upper surface of the lock arm is exposed.

Preferably, a rib is formed on an outer periphery of the hood portion at the first side, and extends over a range corresponding to the width of the first slit.

Preferably, front end portions of the protection side walls extend to the rib so as to be integrally connected to the rib. The front end portions of the protection side walls have a height generally equal to the height of the rib. The protection side walls respectively have second slits which extend in the first direction and are continuous with the first slit.

Preferably, the lock arm has a fulcrum projection provided between the connecting portion and the depressing portion. When the depressing portion is depressed toward the connector body portion, the fulcrum projection abuts against the connector body portion so that the fulcrum projection serves as a fulcrum for leverage so as to cause the connecting portion of the lock arm to be displaced upward.

Preferably, a connector comprising the lock mechanism.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

The present invention has been briefly described above. Details of the invention will become more manifest upon reading the following with reference to the accompanying drawings.

A preferred embodiment of the present invention will now be described in detail with reference to the drawings.

Figure 1:
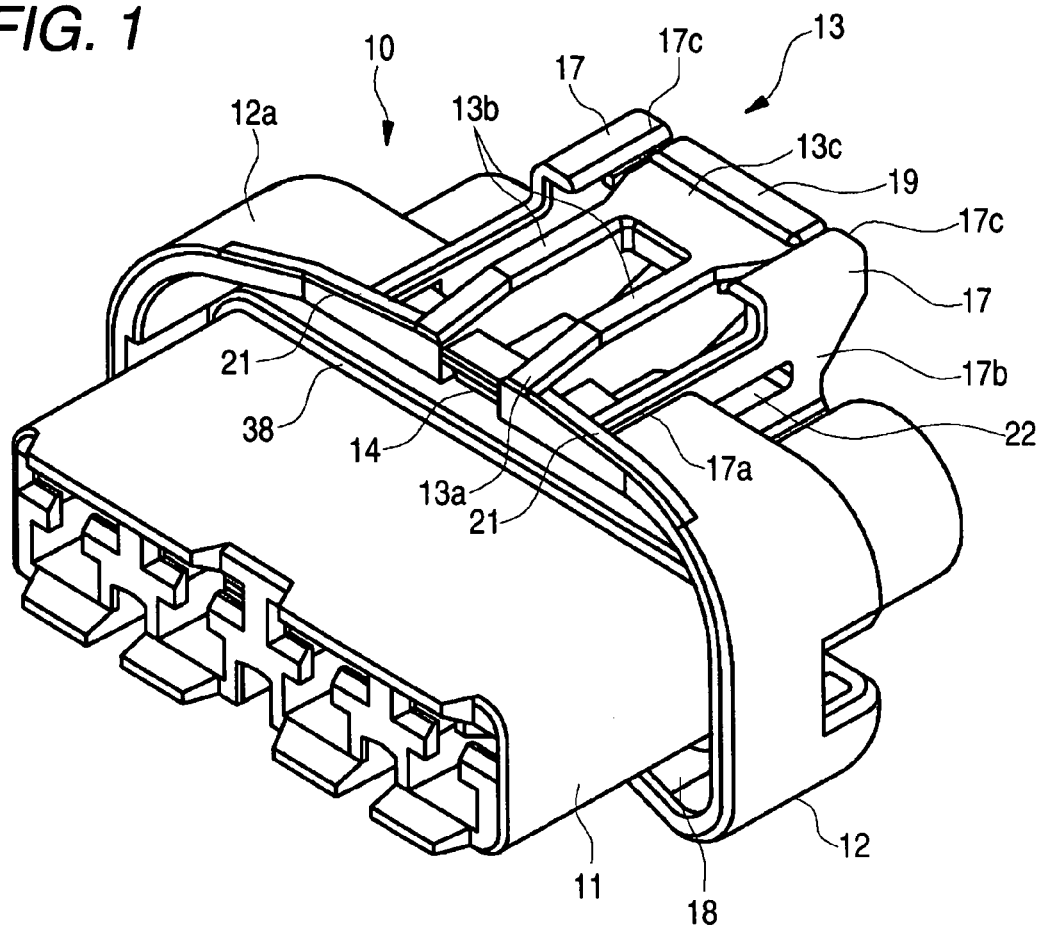
FIG. 1 is a perspective view of a male connector provided with one preferred embodiment of a lock mechanism of the present invention.
Figure 2:
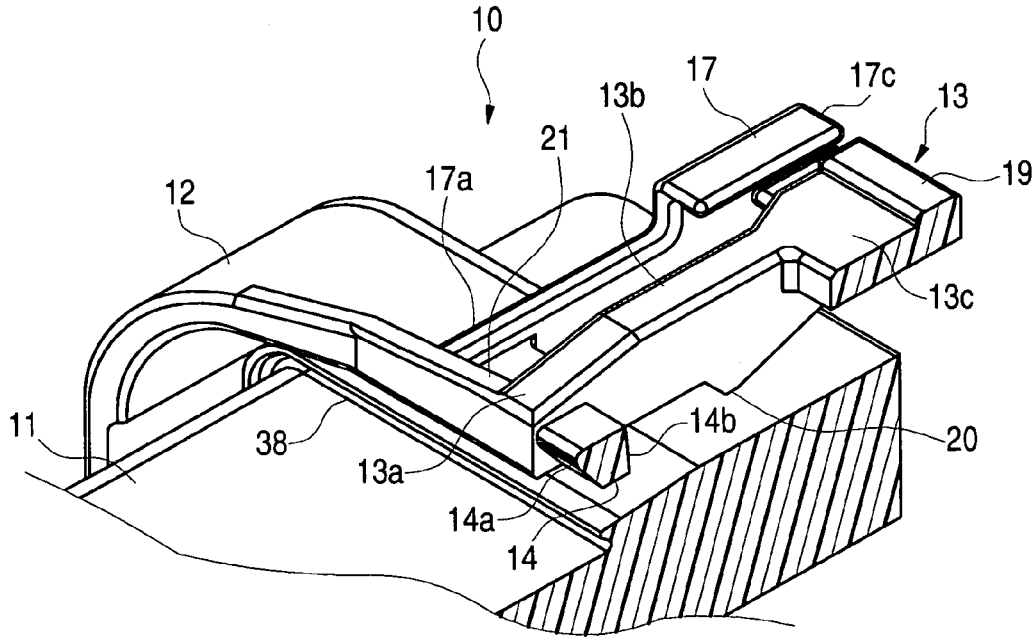
FIG. 2 is a partly-broken, enlarged perspective view of the male connector of FIG. 1.
Figure 3:
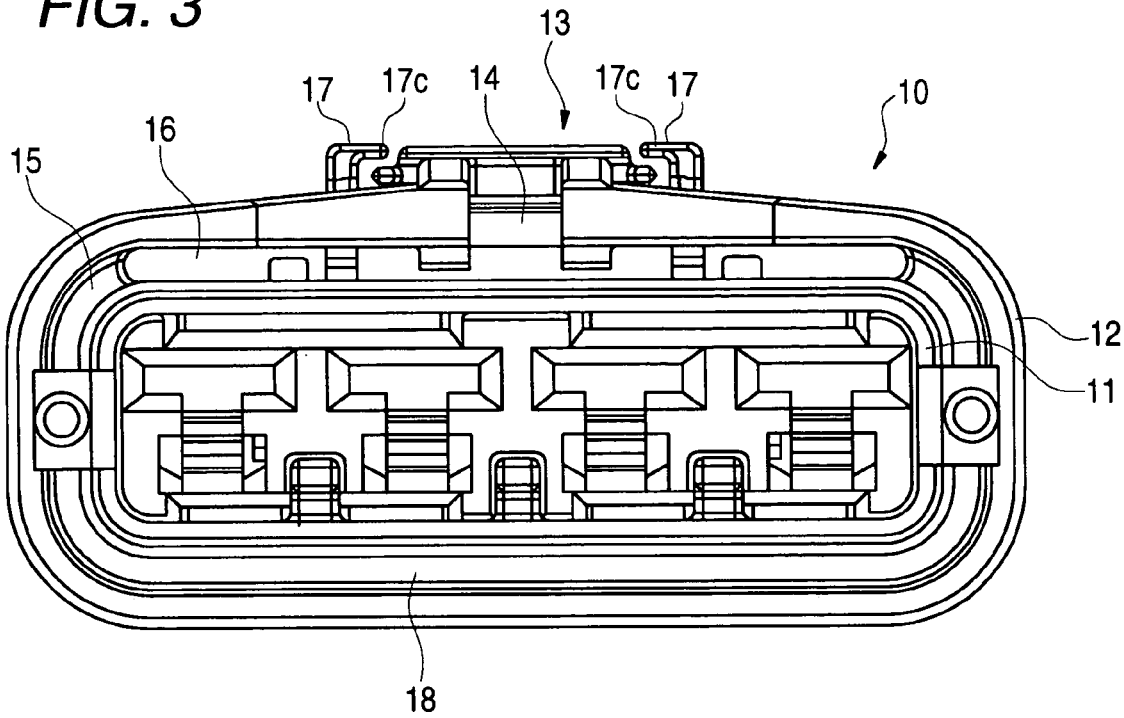
FIG. 3 is a front-elevational view of the male connector of FIG. 1.
Figure 4:
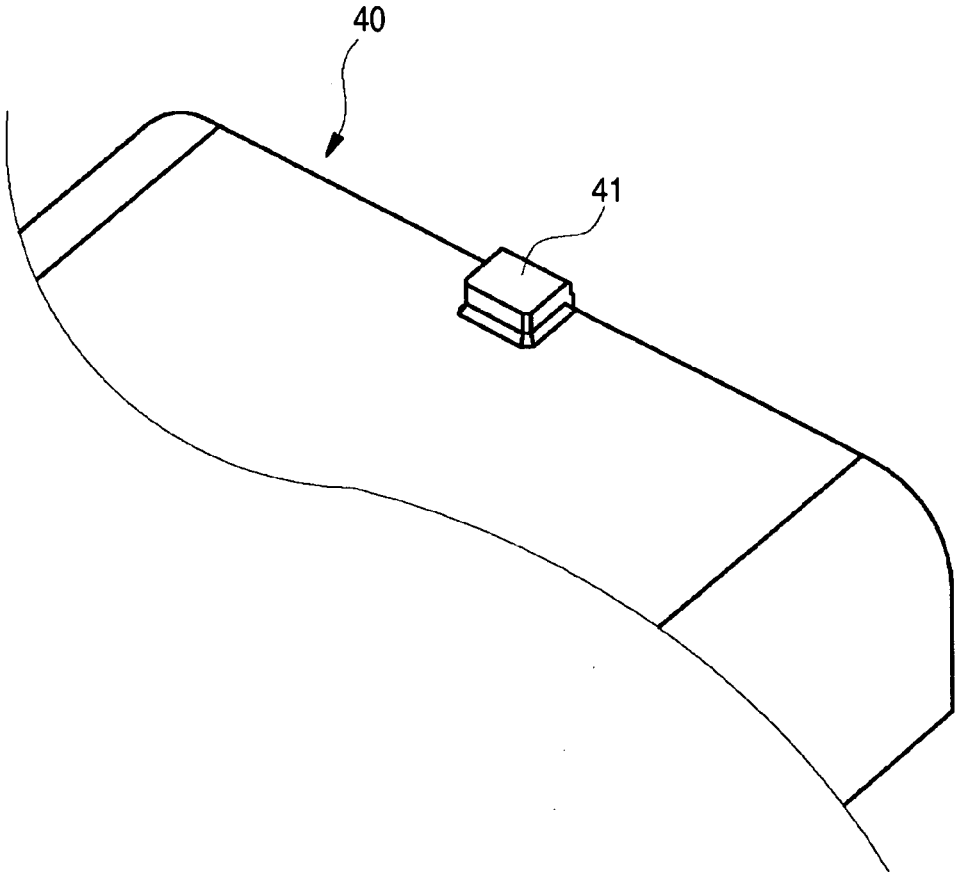
FIG. 4 is a perspective view of an important portion of a female connector (mating connector) for fitting to the male connector of FIG. 1.

FIG. 1 is a perspective view of a male connector provided with one preferred embodiment of a lock mechanism of the invention, FIG. 2 is a partly-broken, enlarged perspective view of the male connector of FIG. 1, and FIG. 3 is a front-elevational view of the male connector of FIG. 1. FIG. 4 is a perspective view of an important portion of a female connector (mating connector) for fitting to the male connector of FIG. 1.

First, with respect to the male and female connectors, an upward-downward direction, a forward-rearward direction and a right-left direction will be defined as follows. With respect to the upward-downward direction, that side where the lock arm or a retaining portion for engagement with the lock arm is disposed is defined as the upper side. With respect to the forward-rearward direction, that side of the connector for fitting to its mating connector is defined as the front side. A direction of juxtaposition of a plurality of terminals is defined as the right-left direction.

As shown in FIGS. 1 to 3, the male connector 10 includes a connector body portion 11 in which the plurality of terminals (not shown) are received in a row, a hood portion 12 provided around the outer periphery of the connector body portion 11, the lock arm 13 which is integrally connected at its front end portion 13*a* to a central portion (in the right-left direction) of an upper wall 12*a* of the hood portion 12, and extends rearwardly from the front end portion 13*a* in a direction parallel to a connector fitting direction, a lock projection 14 formed on an inner surface of that portion of the hood portion 12 to which the front end portion 13*a* of the lock arm 13 is integrally connected, a slit 16 formed in a rear end wall 15 of the hood portion 12, and a pair of right and left protection side walls 17 provided respectively at right and left sides of the lock arm 13 to protect the lock arm 13.

The hood portion 12 is integrally connected to the connector body portion 11 by its rear end wall 15 such that a blind-type annular space 18 (into which the female connector 40 is fitted from the front side) is formed between the outer periphery of the connector body portion 11 and the hood portion 12. The lock arm 13, integrally connected to the hood portion 12, is exposed to the annular space 18. The front end of the connector body portion 11 much projects forwardly beyond the front end of the hood portion 12, and a ring-like seal member 38 is fitted on the outer periphery of that portion of the connector body portion 11 covered with the hood portion 12.

The lock arm 13 includes a pair of right and left longitudinal beam portions 13*b* spaced from each other in the right-left direction, and a transverse beam portion 13*c* interconnecting rear end portions of the right and left longitudinal beam portions 13*b*. An upper surface of the transverse beam portion 13*c* serves as a depressing portion 19 for lock cancellation purposes. An elastic deformation space is secured beneath the lock arm 13.

The lock arm 13 has fulcrum projections 20 formed respectively on the right and left longitudinal beam portions 13*b* and disposed between the front end portion 13*a* (integrally connected to the hood portion 12) and the depressing portion 19 formed at the rear end portion thereof. When the depressing portion 19 is depressed or pressed down toward the connector body portion 11, the fulcrum projections 20 are stopped by the connector body portion 11, and serve as a fulcrum for leverage so as to cause the front end portion 13*a* of the lock arm 13 to be displaced upward. In a non-depressed condition of the lock arm 13, the fulcrum projections 20 are spaced upwardly from the connector body portion 11.

As shown in FIG. 1, the lock projection 14 is disposed between front end portions of the right and left longitudinal beam portions 13*b* of the lock arm 13. The lock projection 14 can be engaged with the retaining projection (retaining portion) 41 formed on the outer periphery of the female connector 40 shown in FIG. 4, and this lock projection 14 includes a slanting surface 14*a* defined by a front end surface thereof, and a retaining surface 14*b* defined by a rear end surface thereof and disposed perpendicularly to the connector fitting direction.

The slit 16, formed in the rear end wall 15 of the hood portion 12, has a width larger than a width of an interconnecting portion of the front end portion 13*a* of the lock arm 13 integrally connected to the hood portion 12, and with this construction the slit 16 performs the function of imparting elastic deformability (corresponding to its width) to part of the upper wall 12*a* of the hood portion 12 which includes the portion thereof integrally connected to the front end portion 13*a* of the lock arm 13. In this embodiment, the slit 16 is formed generally over the entire width of the upper wall 12*a* of the hood portion 12 as shown in FIG. 3.

A rib 21 is formed on the outer periphery of the front end portion (that is, on the upper wall 12*a*) of the hood portion 12 (to which the front end portion 13*a* of the lock arm 13 is integrally connected) by thickening a localized portion of the upper wall 12, and extends over a range corresponding to the width of the slit 16.

The right and left protection side walls 17 are disposed to cover the rear end portion of the lock arm 13, and are separate from the lock arm 13, and extend upwardly from the connector body portion 11 to a level or height generally equal to the height of the lock arm 13. Front end portions 17*a* of the protection side walls 17 extend to the rib 12 formed on the outer periphery of the front end portion of the hood portion 12, and are integrally connected to this rib 21 such that the front end portions 17*a* have a height generally equal to the height of the rib 21.

Each of the protection side wall 17 has a slit 22 extending from the rear end portion of the hood portion 12 to a portion of this side wall 17 disposed forwardly adjacent to the rear end of this side wall 17, such that the protection side wall 17 has an interconnecting leg portion 17*b* formed at the rear side of the slit 22 and integrally connected to the connector body portion 11. The slit 22 is continuous with the slit 16 formed in the rear end wall 15 of the hood portion 12. Lifting prevention walls 17*c* of a generally curved configuration for preventing the lifting of the rear end portion of the lock arm 13 are formed respectively at upper edges of the rear end portions of the pair of protection side walls 17, and are directed inwardly, that is, toward each other.

In the male connector 10 of this construction, the lock arm 13 is provided as an uppermost element in the direction of the height of the connector 10 in such a manner that the whole of the upper surface of this lock arm 13 is exposed.

Next, the operation will be described.

For fitting the male and female connectors 10 and 40 together, the female connector 40 is inserted into the annular space 18 within the hood portion 12 of the male connector 10. As a result, the retaining projection 41 of the female connector 40 abuts against the slanting surface (or front end surface) 14*a* of the lock projection 14 of the male connector 10, and when a larger inserting force is further applied, the retaining projection 41 elastically deforms the upper wall 12*a* of the hood portion 12, and passes the underside of the lock projection 14, and is brought into engagement with the retaining surface (or rear end surface) 14*b* of the lock projection 14. Thus, the locking operation is completed.

For canceling the fitted condition, the depressing portion 19 at the rear end portion of the lock arm 13 is depressed. As a result, the front end portion of the lock arm 13 is raised by leverage while elastically deforming the upper wall 12*a* of the hood portion 12, so that the lock projection 14 is disengaged from the retaining projection 41, and in this condition the male and female connectors 10 and 40 are moved apart from each other, thereby canceling the fitted condition.

Figure 5:
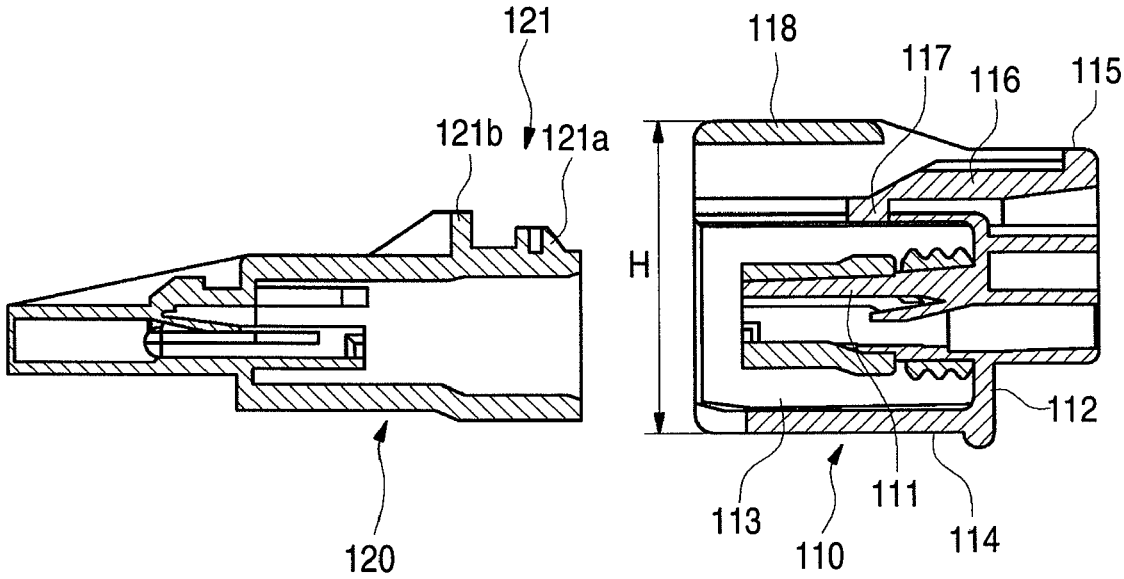
FIG. 5 PRIOR ART
FIG. 5 is a cross-sectional view of a related example.

In the male connector 10 of this embodiment, the lock arm 13 is provided as the uppermost element in the direction of the height of the connector 10 in such a manner that the whole of the upper surface of this lock arm 13 is exposed, and therefore there is not provided any element (such as the bulging wall in the related connector of FIG. 5) which would prevent the achievement of the low-height design, and the height of the connector 10 can be reduced to a low level generally equal to the height of the hood portion 12.

Although the bulging wall is eliminated, the lock arm 13 is protected by the protection side walls 17 extending upwardly from the connector body portion 11, and therefore it is not feared that the lock arm 13 is immoderately moved by an external force. And besides, the protection side walls 17 are separate from the lock arm 13, and therefore will not adversely affect the elastic deformability of the lock arm 13.

Furthermore, for fitting the male and female connectors 10 and 40 together or for disengaging the male and female connectors 10 and 40 from each other, the lock projection 14 on the inner surface of the hood portion 12 can be brought into and out of locking engagement with the retaining projection 41 of the female connector 40 while elastically deforming part of the hood portion 12 thanks to the provision of the slit 16 in the rear end wall 15 of the hood portion 12. In this case, the elastic deformability (that is, the degree of elastic deformation) of the hood portion 12 can be determined by the width of the slit 16, and therefore the inserting force required for the connectors 10 and 40 and the canceling force required for the lock arm 13 can be easily suitably adjusted at the stage of the design.

Furthermore, the rib 21 is formed on the outer periphery of the front end portion (that is, on the upper wall 12*a*) of the hood portion 12 (to which the front end portion 13*a* of the lock arm 13 is integrally connected) by thickening the localized portion of the upper wall 12, and extends over the range corresponding to the width of the slit 16, and therefore the hood portion 12 can be reinforced without adversely affecting the elastic deformability of part of the hood portion 12. Particularly, the portion of the hood portion 12 to which the front end portion of the lock arm 13 is integrally connected and on which stresses are liable to concentrate can be reinforced. And besides, the effect of dispersing the stresses over the range or region where the rib 21 is provided can be achieved, and therefore the hood portion 12 can be elastically deformed over a wide range, so that a high degree of elastic deformation can be imparted to the hood portion 12.

Furthermore, the front end portions 17*a* of the protection side walls 17, protecting the lock arm 13, extend to the rib 21, and are integrally connected to this rib 21, and therefore the front half portion of the lock arm 13 can also be protected from an inadvertent external force. And besides, the slit 22, which is continuous with the slit 16 in the rear end wall 15 of the hood portion 12, is formed in each of the thus extended protection side walls 17, and therefore it is not feared that the elastic deformability of the hood portion 12 is adversely affected by the protection side walls 17.

Furthermore, the lock arm 13 has the fulcrum projections 20 (serving as the fulcrum for leverage) formed between the front end portion 13*a* thereof (integrally connected to the hood portion 12) and the depressing portion 19 formed at the rear end portion thereof, and therefore when the depressing portion 19 at the rear end portion of the lock arm 13 is depressed, the front end portion 13*a* of the lock arm 13 (integrally connected to the hood portion 12) can be easily lifted with each fulcrum projection 20 functioning as the support point. Therefore, the locking engagement of the lock projection 14 with the retaining projection 41 of the female connector 40 can be easily canceled.

The present invention is not limited to the above embodiment, and suitable modifications, improvement, etc., can be made. Furthermore, the material, shape, dimensions, numerical value, form, number, disposition, etc., of each of the constituent elements of the above embodiment are arbitrary, and are not limited in so far as the invention can be achieved.

For example, although the above embodiment is directed to the male connector provided with the lock mechanism, the connector with the lock mechanism of the invention is not limited to the male connector, but may be a female connector. In the case where the female connector is provided with the lock mechanism of the invention, the mating connector for fitting to the female connector is, of course, a male connector.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

What is claimed is:

1. A lock mechanism of a connector, comprising:

a connector body portion that receives terminals therein;

a hood portion that is provided around an outer periphery of the connector body portion so that an annular space into which a mating connector can be fitted from a first side is formed between the hood portion and the outer periphery of the connector body portion; and a lock arm that includes a connecting portion, an extending portion and a depressing portion for lock cancellation, wherein the connecting portion of the lock arm is integrally connected to the hood portion at the first side, the extending portion extends from the connecting portion to the depressing portion in a first direction of fitting the mating connector into the connector body portion, and the depressing portion is arranged at a second side which is away from the mating connector than the first side in the first direction;

wherein an end wall of the hood portion is integrally connected at the second side to the connector body portion;

wherein a first slit is formed in the end wall of the hood portion, and has a width larger than a width of an interconnecting portion which connect the connecting portion of the lock arm to the hood portion, so that the first slit applies elastic deformability, corresponding to the width of the first slit, to a part of the hood portion including the interconnecting portion;

wherein a pair of protection side walls are provided respectively at both sides of the lock arm to protect the lock arm, and are separated from the lock arm, and have a height generally equal to a height of the lock arm;

wherein a rib is formed on an outer periphery of the hood portion at the first side, and extends over a range corresponding to the width of the first slit;

wherein front end portions of the protection side walls extend to the rib so as to be integrally connected to the rib;

wherein the front end portions of the protection side walls have a height generally equal to the height of the rib; and wherein the protection side walls respectively have second slits which extend in the first direction and are continuous with the first slit.

2. The lock mechanism according to claim 1, wherein the lock arm is provided as an uppermost element in a direction of the height of the connector such that a whole of an upper surface of the lock arm is exposed.

3. The lock mechanism according to claim 1, wherein the lock arm has a fulcrum projection provided between the connecting portion and the depressing portion; and wherein when the depressing portion is depressed toward the connector body portion, the fulcrum projection abuts against the connector body portion so that the fulcrum projection serves as a fulcrum for leverage so as to cause the connecting portion of the lock arm to be displaced upward.

4. A connector comprising the lock mechanism according to claim 1.

* * * * *